United States Patent [19]

Troxclair

[11] 3,952,338

[45] Apr. 27, 1976

[54] THERAPY BASIN

[76] Inventor: Robert S. Troxclair, 1365 Norman Road, Colton, Calif. 92324

[22] Filed: Apr. 21, 1975

[21] Appl. No.: 570,171

[52] U.S. Cl. ..... 4/172.15; 4/172.19; 52/184

[51] Int. Cl.[2] ..... E04H 3/16; E04H 3/18

[58] Field of Search ..... 4/172, 172.15, 172.16, 4/172.17, 172.18; 128/369, 371, 400; 52/184

[56] References Cited

UNITED STATES PATENTS

| | | | |
|---|---|---|---|
| 2,803,835 | 8/1957 | Summers | 4/172.19 |
| 3,236,012 | 2/1966 | Laven | 4/172.19 |
| 3,483,863 | 12/1969 | De Vane | 4/172.15 |
| 3,623,165 | 11/1971 | Whittell, Jr. | 4/172.15 |
| 3,755,981 | 9/1973 | West | 4/172.19 X |
| 3,781,925 | 1/1974 | Curtis | 4/172.15 |
| 3,848,378 | 11/1974 | Witte | 4/172 |

*Primary Examiner*—Henry K. Artis
*Attorney, Agent, or Firm*—Gausewitz, Carr & Rothenberg

[57] ABSTRACT

An integral, open-sided basin is formed with body supporting steps, a number of air jets and fittings for water circulation. The open side is connected to a corresponding opening in the wall of a swimming pool and the opening is selectively closed by a removable divider panel to allow the basin to serve as pool entry or exit, a therapy pool at the side of the swimming pool, or, when connected to another identical therapy basin, to serve as a totally independent and self-contained therapy pool.

14 Claims, 10 Drawing Figures

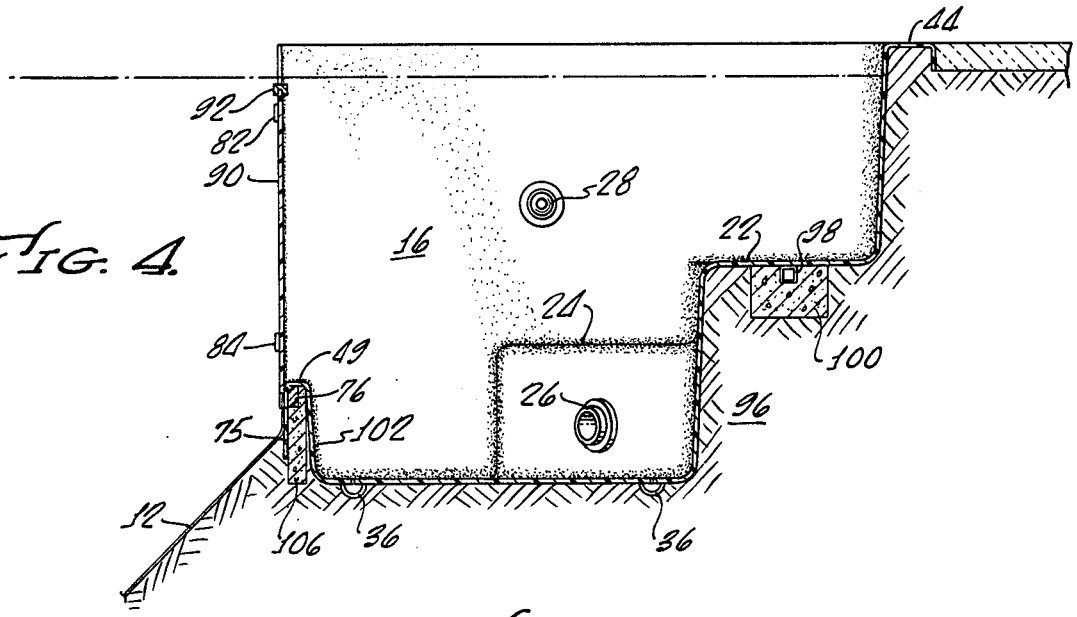
FIG. 4.
FIG. 5.
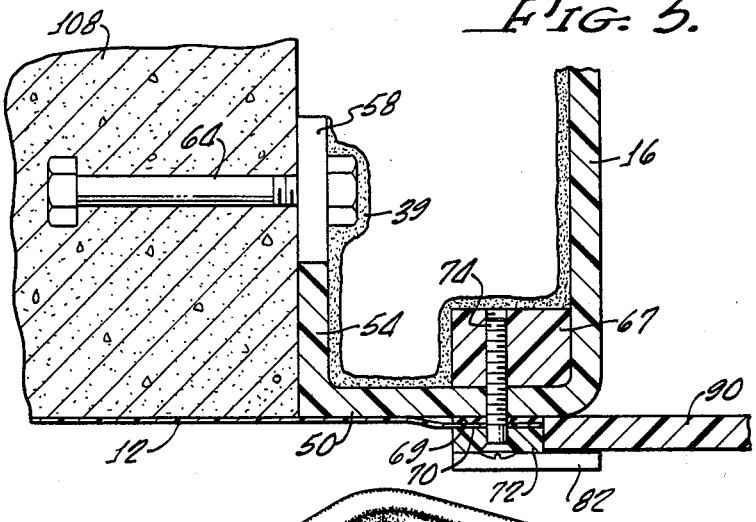
FIG. 6.
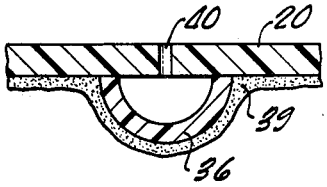
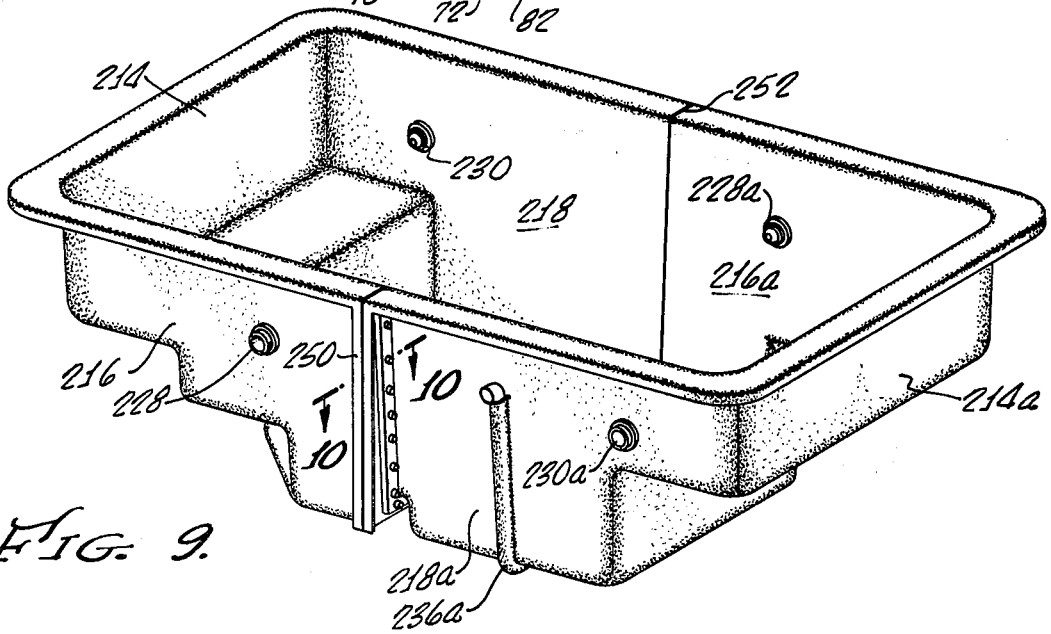
FIG. 9.

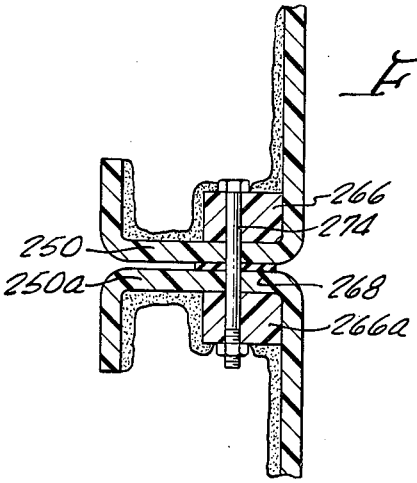
FIG. 10.
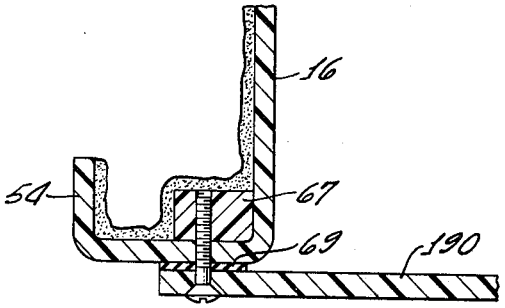
FIG. 8.
FIG. 7.
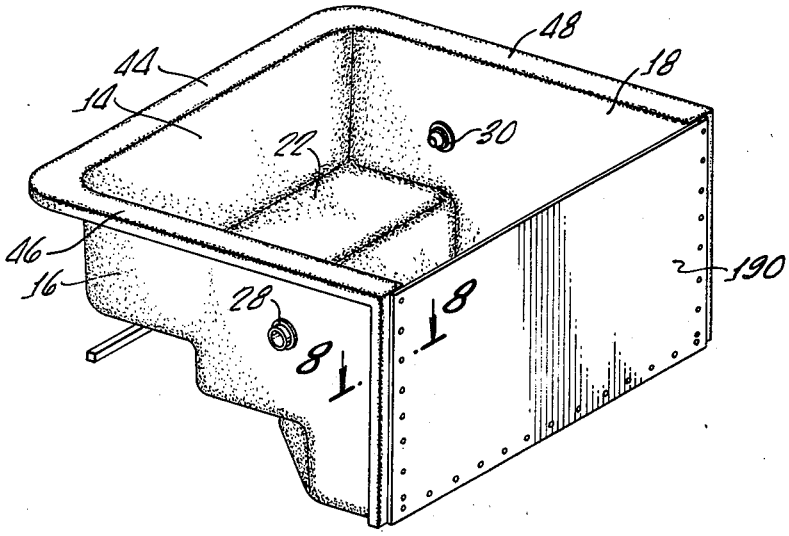

THERAPY BASIN

BACKGROUND OF THE INVENTION

A common type of home swimming pool construction, widely employed because of lower cost, involves forming an opening in the ground and lining the opening with a sheet of plastic such as a vinyl plastic. In this type of construction, as distinguished from the so-called gunnite construction wherein a fluid concrete is sprayed over a steel reinforcing web, it is neither convenient nor economically practical to provide the pool with built in steps for entry and exit. Accordingly, some type of ladder is generally employed for pool entry. It is known, as shown in U.S. Pat. Nos. 3,236,012 to Laven, 3,755,981 to West and 3,848,378 to Witte, for example, to provide stairs for such vinyl lined swimming pools, extending upward and outward from the side of the pool. These structures use complex and costly arrangements for anchoring the steps to the earth surrounding the pool structure and for connecting and sealing the step construction to the pool structure itself.

In conventional gunnite type swimming pools there is increasingly wide application of built-in therapy pools. A laterally extending basin area is formed integrally with the pool and separated therefrom by a divider that extends to a point just below the water level surface so as to provide a limited water communication between the therapy area and the main body of the pool. Various arrangements have been provided to enable selective control of the normal water recirculation and heating for the main pool body and for the therapy area, typical apparatus of this type being shown in U.S. Pat. Nos. 3,623,165 to Whittell, Jr., 3,781,925 to Curtis et al., and 3,801,992 to Sable. Such therapy basins have not heretofore been available for the less expensive plastic lined swimming pools and, moreover, have required structures that limit the use of the therapy area by permanently separating this area from the main body of the pool.

Accordingly, it is an object of the present invention to provide a single structure that affords an inexpensive solution to the above-mentioned problems of both entry and therapy basins.

SUMMARY OF THE INVENTION

In carrying out principles of the present invention a combined pool entry and therapy basin for a swimming pool comprises a self-contained open-sided basin adapted to be connected at its open side in water tight relation to the wall of the pool and carrying support means for supporting the body of a person in the basin and air jet means are provided for directing a plurality of air jets into the interior of the basin. The support means is useful as either a step or a seat and a removable divider panel extends across the open side of the basin to permit use, alternatively as a substantially separate therapy area or a pool entry and exit. According to another feature of the invention two identical therapy basins are interconnected with each other to define self-contained therapy pool, thereby affording a number of different usages for a single unitary basin.

BRIEF DESCRIPTION OF THE DRAWINGS

FIGS. 4, 5 and 6 are sections taken on lines 4—4, 5—5, and 6—6, respectively, of FIG. 1;

FIG. 7 illustrates the basin of FIG. 2 with a fixedly attached divider panel to provide a smaller sized self-contained therapy pool;

FIG. 8 is a section taken on lines 8—8 of FIG. 7;

FIG. 9 illustrates two of the basins of FIG. 2 connected to each other to provide a self-contained and fully independent therapy pool; and FIG. 10 is a section taken on lines 9—9 of FIG. 9.

DETAILED DESCRIPTION

Figure 1:
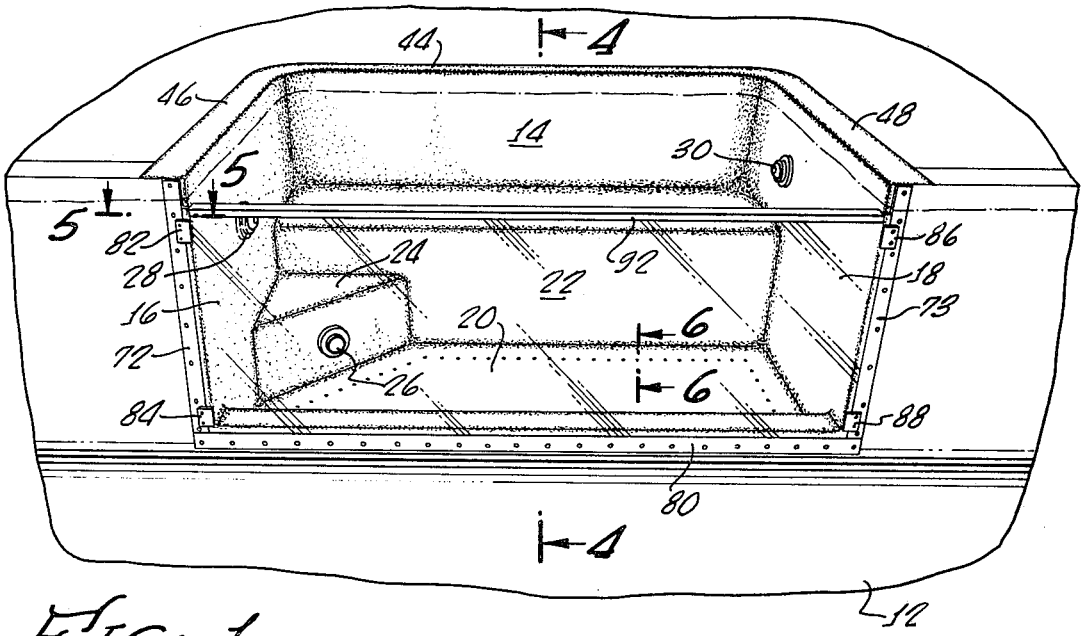
FIG. 1 is a perspective view of a therapy basin embodying principles of the present invention as connected in the opening of the side of a vinyl lined swimming pool.
Figure 3:
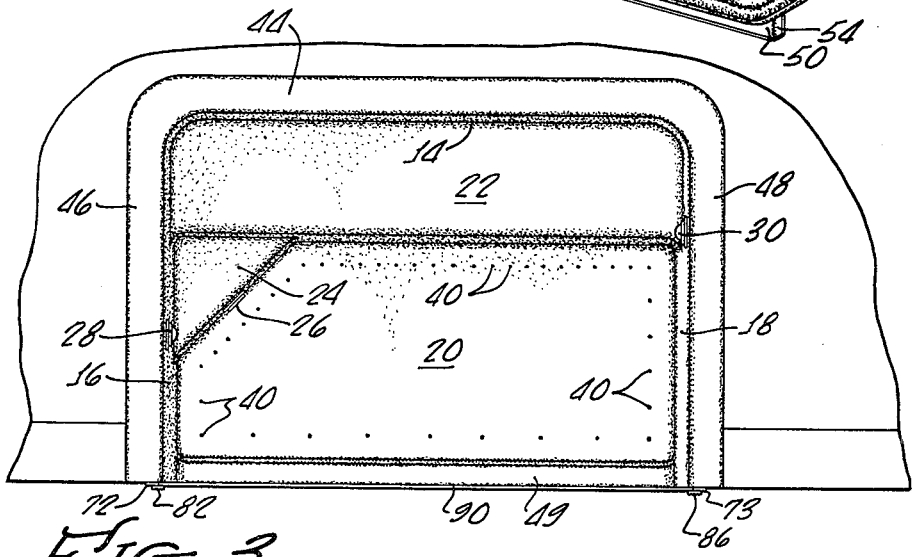
FIG. 3 is a top plan view of the basin and part of the swimming pool of FIG. 1.

Illustrated in FIG. 1 is a fragmentary view of the side of a swimming pool that is constructed with an opening to receive a therapy basin embodying principles of the present invention. The swimming pool, which may be of widely varying construction, is illustrated in FIGS. 1, 3 and 5 as embodying a side wall 10 formed of poured concrete, blocks or other rigid structural material which defines sides and the bottom of the pool. An integral sheet of water-impervious material, such as a vinyl plastic liner 12, completely covers the inner surface of the swimming pool walls and bottom, having openings for connection with a conventional water re-circulation system. For use with the described therapy basin, an opening is left in the side wall extending from the top of the pool wall toward the bottom. The opening may be formed in any part of the pool, at either side, at the deep end, or at the shallow end, provided only that the opening is in a part of the pool having a water depth of approximately two feet or more in order to accomodate the full 30 inch depth of the exemplary therapy basin described herein.

The basin is formed of a unitary integral shell conveniently molded of any one of a number of hard, rigid and water-impervious plastic materials, such as PVC, ABS, Lexan or Delrin, which are among the many plastics suitable for construction of the described basin. A preferred form of construction is the lay-up of layers of fiberglass impregnated with resin, or a sprayed mixture of resin and short lengths of fiberglass, formed or sprayed over a suitably shaped mold. The basin is formed with a rear wall 14, first and second side walls 16, 18, and a bottom 20. The rear wall 14 is provided with an integrally formed step 22 extending the full width of the basin. A second step in the form of a lower triangular shaped corner seat 24 is integrally formed between the side 16 and the riser of step 22. Suitable non-skid coverings may be secured adhesively or otherwise to the outwardly facing horizontal surfaces of the basin bottom and steps. Conveniently, a water drain fitting 26 is secured to the riser of the lower step 24 and a pair of water input fittings 28, 30, providing inwardly directed water jets are fixedly secured to and extend through the side walls 16, 18.

An arrangement for providing a pattern of air jets from the bottom of the therapy basin comprises a tubular conduit 34 formed in a closed loop pattern on the exterior of the bottom of the basin. The conduit includes an upwardly extending conduit arm 36 secured to the exterior of side 18 and having a fitting 38 for connection to a source of pressurized air (not shown). As previously noted, the shell may be made of layers of resin-impregnated fiberglass laid up over a suitable mold. The shell body, after molding, is sprayed with a mixture of resin and glass fibers, which is sprayed over the conduit 34 to secure this conduit to the outside of the shell by an outer layer 39, as best illustrated in FIG. 6. Conveniently the conduit 34 is formed of split tubular conduit providing a semi-circular cross-section having its open side abutting against the outside of the bottom surface of the shell. After securement of the conduit to the shell, a number of air jet holes such as aperture 40, FIG. 6, are drilled through the shell bottom wall for communication with the interior of the air conduit.

Figure 2:
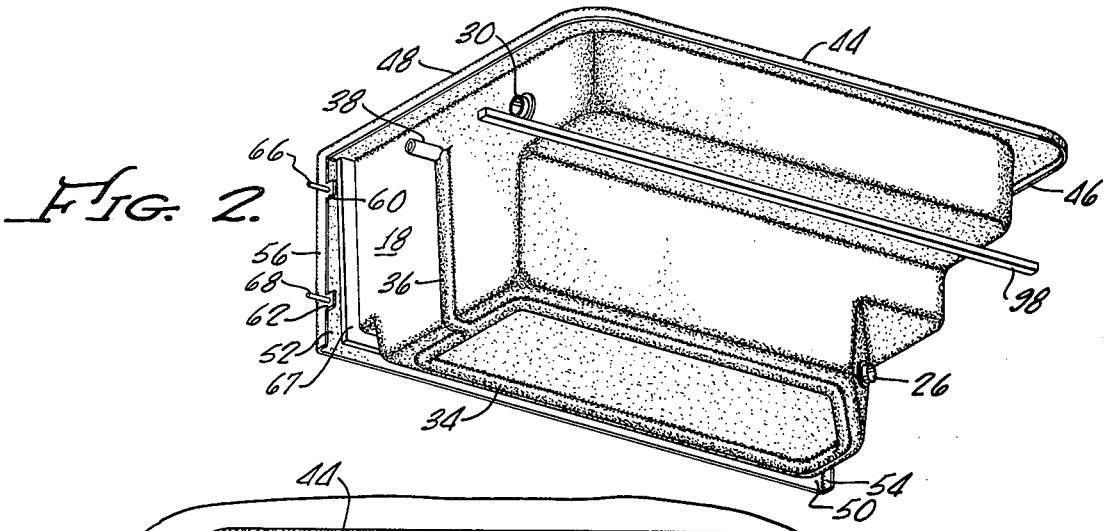
FIG. 2 is a perspective view of the underside of the therapy basin prior to installation in a swimming pool.

The rear and side walls of the shell are formed with laterally outwardly projecting flange sections 44, 46 and 48 having the outer edges thereof turned downwardly as best seen in the perspective view of FIG. 2. The forward edges of the shell which define the opening at the open side of the basin include integral laterally extending flanges 50, 52 each of which is reversely bent as at 54, 56 and formed with integral rearwardly projecting tongues such as indicated at 58 in FIG. 5 and 60, 62 in FIG. 2. These rearwardly projecting tongues 58, 60 and 62 receive captured stabilizing bolts 64, 66, 68 having their heads covered by the layer 39 of subsequently sprayed-on resin impregnated glass fiber. Preferably there are two or more of such tongues and stabilizing bolts on each side flange 50, 52.

The side edges at the open side of the basin form rearwardly directed or rearwardly opening channels in which are fixedly mounted vertically extending reinforcing bars of which one, designated at 62, is illustrated in FIG. 5. A vertically extending gasket 69 is placed along the outside of the side flanges 50, 52 and provides and enhances the sealing of the edge 70 of the vinyl liner 12 of the swimming pool. The liner edge is tightly pressed against gasket 69 by means of a vertically extending face plate 72 held in place by a number of bolts 74 extending through the faceplate, through the vinyl liner edge, through the gasket 69 and into threaded apertures of reinforcing bar 67. The construction of the side edges and the leak free sealing arrangement of the vinyl liner, as illustrated in FIG. 5, are identical for each of the two sides of the therapy basin. The sealing arrangement at the bottom edge is similar, encompassing a downwardly facing reinforcing channel extending along the bottom of the basin and defined by a reversely bent basin flange 75 (FIG. 4) having a horizontally extending reinforcing bar 76 secured thereto just as described in connection with the reinforcing bar 67. A gasket and face plate are employed between which an edge of the vinyl liner is sandwiched, all fixed in place by a number of bolts extending through the lower face plate 80 and clamping the vinyl liner edge against the lower flange of the basin opening.

To enable the described basin to alternatively perform its dual functions, namely, providing free and unobstructed access to and from the body of the main pool, and also providing a substantially separate therapy pool area adjoining the main pool, the edges of the open side of the basin are formed with vertically extending guideways defined by relatively short, inwardly extending flat guideway plates 82, 84, 86 and 88, which are bolted or otherwise fixedly secured to the forwardly facing outer surfaces of the face plates 72, 73 at respectively opposite sides of the open side of the basin. As best seen in FIG. 5, each of the face plates is offset laterally outwardly from the edge of the corresponding sidewall such as wall 16 and the guideway plate cooperates with the lateral flange of the sidewall between the face plate and the sidewall to define a vertically extending guideway. Thus, there are provided mutually opposed facing guide channels which slidably receive a rigid divider panel 90, preferably formed of a solid relatively thick sheet of plastic such as a transparent plexiglass, for example. Divider panel 90 is a relatively snug but freely sliding fit within the guideway channels so that it may be readily removed and inserted by hand. Conveniently, the upper edge of the divider panel is provided with a reinforced edge 92 fixed thereto and extending for the full length of the panel to thereby both strengthen the divider panel and facilitate handling.

Installation of the therapy basin and access steps illustrated herein is best shown in FIGS. 4 and 5 wherein the ground 96 beneath and around the area at which the basin is to be installed is excavated and formed to a shape congruent with the shape of the basin. For anchoring the rear of the basin, a rigid bar such as a steel tube or angle 98 is fixedly secured to the bottom of the tread of step 22, being covered with the sprayed on resin impregnated fiber that coats the entire outer surface of the basin shell. This structural retaining bar 98 extends laterally outwardly beyond both sides of the basin (FIG. 2) and is imbedded in an elongated block of concrete 100 that is poured in place in a suitable trench excavated in the basin supporting ground 96.

Preferably, the ground is packed tight within the laterally extending flanges such as flange 44, at all of the upper edges of the sides of the basin and all of the supporting earth is tightly compacted for optimizing its load-carrying characteristics. A relatively low upstanding front wall 102 is integrally formed with the previously described forwardly and reversely bent flange 49 that fixedly carries the reinforcing structural bar 76 to which the liner 12 is secured in a leak-free arrangement as described above. To anchor the lower forward edge of the basin to the ground, a rigid laterally extending structural beam 106 of wood, steel or concrete, is anchored in the ground and formed to extend completely into the upper end of the channel formed by reversely bent flange 49, snugly interengaging the reinforcing bar 76 fixed therein. Beam 106 is securely anchored to the ground by any suitable means. Forward edges of the sides of the basin are anchored to the ground preferably by having the retaining bolts, such as bolts 64, 66, 68 thereof, (FIGS. 2 and 5) embedded in bodies of concrete 108 that are poured in place within the earth after the basin has been properly positioned with respect to the rest of the pool structure. No special liner configuration is employed since it is merely necessary to cut away a section of the liner to substantially conform with the opening in the side of the therapy basin. The cutting of the liner section may be performed after completion of the installation of the basin and the securing and sealing of the uncut liner between the gasket and face plates. For this liner cutting step, it may be convenient to temporarily remove the guideway plates 82, 84, 86, 88 so as to facilitate cutting and removal of the unnecessary liner section.

The installation illustrated in FIGS. 4 and 5 is typical of the use of the described basin with the conventional vinyl lined home swimming pool. With the divider panel 90 removed, the basin provides a convenient entry and exit for the pool by means of steps 22, 24. By suitable valving, well known in the art, the water conduit fittings 26, 28, 30, may be disabled to block these fittings and water will be recirculated in a conventional fashion throughout the rest of the pool. Generally, it is not necessary to flow air jets through the conduit 36 and apertures 40 with the divider panel 90 removed. Nevertheless, it is possible to do so.

For use as a separate therapy pool adjoining the main pool, divider panel 90 is inserted in the guideways formed by guideway plates 82, 84, 86, 88 so that the bottom edge thereof seats upon the lower face plate 80 and its upper edge, including reinforcing edge structure 92, is slightly below the normal water line of the main body of the pool. It is not necessary to provide any seal between the dividor panel and guideways since leakage between the separate therapy area and main pool has no adverse affect. Preferably, the top of the divider panel 90 is below the surface of the water to provide a substantially separated therapy pool area and to enable overflow from the therapy area to flow into the main body of the pool. However, such an arrangement is not required in use of the described basin because the therapy pool area itself is provided with a complete set of recirculating water conduits to flow water jets into the therapy pool area via conduit fittings 28, 30 and to withdraw water therefrom via drain conduit fitting 26. For use as a therapy pool, pressurized air is forced, via fitting 38 and conduit 34, through apertures 40 in the bottom of the basin to provide the desired spa action. Fittings 28 and 30, which may be more than two in number also provide forced water jets having a therapeutic action. Under these conditions, steps 22 and 24 provide body supports for a person seated or reclining within the therapy pool and partially submerged therein. It will be readily appreciated that the body supports or steps 22, 24 may be fewer or greater in number and formed in other arrangements or sizes than the exemplary configuration illustrated in the drawings.

The basin may be made in many different sizes and configurations which provide an open side and the appropriate body supports capable of functioning either for supporting a person seated or reclining or as steps for access. Nevertheless, in a typical installation, the basin will be approximately six feet wide, from one side wall to the other, four feet long, from the rear wall to the open side, and will have a total depth of 30 inches.

Not only does the described therapy basin provide two separate and different functions when installed in an opening of the wall of a conventional vinyl lined pool, but the very same basin may be employed as a self-contained therapy pool, independent of any connection with another pool, in the manner illustrated in FIGS. 7 and 8. Thus, as shown in this Figure, the guideway plates 82, 84, 86 and 88 of FIG. 1 are omitted and a divider panel 190 in the form of a rigid sheet of plastic having edge reinforcing (not shown) is fixedly and permanently secured by a plurality of bolts to the reinforcing bars 67, 76 on both sides and the bottom of the basin. This self-contained basin, which is otherwise identical to the combined therapy pool and steps previously described, is mounted in any suitable fashion as in an appropriately formed excavation, for example, or any other suitable support, and its water and air conduit fittings connected just as previously described so as to afford water jets from fittings 28, 30 and air jets via the holes 40 (not shown in FIG. 7). Thus, all of the desirable features of a totally independent therapeutic pool in a minimum area are provided.

The arrangement previously described may be employed for a separate, independent and totally self-contained therapy pool of increased size by connecting two identical basins of the type previously described to each other in the manner illustrated in FIGS. 9 and 10. In this arrangement, the side and bottom face plates are omitted and only a single gasket 268 (FIG. 10) is interposed between common facing lateral flanges, such as flanges 250 and **250*a* of the face-to-face connected basins. Thus, there is provided a first basin substantially identical to that described in FIGS. 1 through 4 having a rear wall 214, side walls 216 and 218 and a front opening defined by side flanges 250, 252. The basin includes water inlet jets 228 and 230 and a water drain identical to drain 226 (not shown in FIG. 9. An air conduit and air jet (not shown in FIG. 9) identical to the corresponding elements of the embodiment illustrated in FIGS. 1 through 6** are also provided.

The second mating and identical half of this dual unit therapy pool of FIG. 9 includes side walls **216*a*, 218*a*, a rear wall 214*a*, input water jets 228*a*, 230*a*, and an air conduit including conduit section 236*a* connected to air jets (not shown in FIG. 9) just as previously described. The two identical basins are bolted together and sealed in face-to-face relation with gasket 268 interposed between the juxtaposed side flanges 250, 250*a*, and like flanges on the other side of the basins by means of a plurality of bolts such as bolt 274 extending entirely through a reinforcing bar such as 266 and 266*a* as shown in FIG. 10.** The bottom edges of the two identical basins are similarly bolted together by a plurality of bolts and sealed by an interposed gasket to provide an enlarged unitary self-contained and independent therapy pool having dimensions of about 6 feet in width and 8 feet in length. The combined dual basin may be installed in a suitable excavation or may be otherwise supported with the upper edge at or above ground level as deemed necessary or desirable. Air and water connections, previously described, will be made to one or both of the units as deemed necessary or desirable.

It is important to note that the described configuration enables use of the very same mold to manufacture a basin that can be employed for a number of different purposes. To recapitulate, the same basin made from the one mold can provide a pre-built set of steps for access to and from the interior of a full-sized vinyl lined pool. Alternatively, with the divider panel in place the very same basin and installation provides a therapy pool in conjunction with the main pool, sharing the main pool water heating and recirculating system. Still further, the very same basin, instead of being installed as a part of a pool may be made in two different configurations, that shown in FIG. 7 and that shown in FIG. 9, to provide independent self-contained therapy pools apart from any main pool application.

The foregoing detailed description is to be clearly understood as given by way of illustration and example only, the spirit and scope of this invention being limited solely by the appended claims.

What is claimed is:

1. A combined pool entry and therapy basin for a swimming pool comprising wall means defining a self-contained water impervious basin open at one side thereof and adapted to be connected as a unit to an opening in the wall of a pool, means for connecting said basin at its open side in water tight relation to the wall of a pool at said opening thereof, support means carried on said wall means for supporting the body of a person in said basin, below the water line, and air jet means in said wall means for directing a plurality of airjets into the interior of said basin.

2. The apparatus of claim 1 wherein said support means includes a plurality of steps affixed to said wall means.

3. The apparatus of claim 1 including water jet means in said wall means for directing a water jet into the interior of said basin and a water drain formed in said wall means.

4. The apparatus of claim 1 including a divider panel extending across the open side of said basin and means for removably securing said divider panel to said basin.

5. The apparatus of claim 1 wherein said support means includes a plurality of steps, and further including a divider panel extending across said open side of said basin and having a top positioned below the water line of said pool, and means for movably connecting said divider panel to said basin for movement between a first position in which the divider panel extends across said open side to substantially close said basin and provide a therapy area for said pool and a second position in which said divider is displaced from said basin and permits free and unobstructed passage of a person between the pool and said basin for entry and exit.

6. The apparatus of claim 5 wherein said means for movably connecting said divider panel to said basin comprises guide means for defining a pair of mutually facing vertically extending guideways at opposite edges of the open side of said basin, said divider panel being slidably and removeably received in said guideways.

7. The apparatus of claim 1 wherein said wall means comprises an integral shell formed with mutually spaced sidewalls on either side of said open side, a rear wall, and a bottom wall, said rear and bottom wall being configured to form said support means, said air jet means comprising tubular conduit means secured to the exterior of said shell and having an air supply connection, and a plurality of apertures extending through said shell into communication with said conduit means.

8. The apparatus of claim 7 wherein said side walls extend substantially vertically and wherein forward edges of said side walls on either side of said open side are reversely bent to form vertically extending channels defining and reinforcing edges of said basin opening, first and second reinforcing bars mounted within said channels, first and second face plates extending along the forward edges of said first and second channels and adapted to seal the edge of a vinyl pool liner between the face plates and respective channels, said face plates being fixedly secured to said channels and to said reinforcing bars.

9. The apparatus of claim 8 including a rigid structural member secured to said shell beneath said bottom wall and extending outwardly in both directions beyond said sidewalls to facilitate anchoring said basin.

10. The apparatus of claim 9 including a plurality of laterally outwardly extending rods fixed to said reversely bent forward edges to facilitate connection of said basin with a pool structure.

11. An integral unitary therapy basin adapted to be employed either as a combined pool entry and therapy area for a swimming pool or to be used in duplicate to provide a self-contained completely independent therapy pool, said basin comprising an integral molded shell formed with a pair of side walls, a rear wall and a bottom wall, and being open at one side thereof, said walls being formed to define body support means for support of a person within the shell above the bottom wall thereof, said side walls each having a laterally outwardly bent flange, means for securing said side wall flanges alternatively to like sidewall flanges of a second identical basin to thereby define a symmetrical self-contained therapy pool, or to edge structure of an opening in a swimming pool to thereby define an entry and exit for said swimming pool, airjet means in said shell for directing a plurality of airjets into the interior of said basin, and means for providing entry and drainage of water to and from the interior of said basin.

12. The basin of claim 11 including a divider panel extending across the open side of said basin, and means for connecting said panel to said basin.

13. The apparatus of claim 12 wherein said means for connecting said divider panel to said basin comprises guide means formed on forward edges of said side walls for slidably and removeably receiving said divider panel.

14. The apparatus of claim 11 wherein said airjet means comprises a conduit sealed to the exterior of said shell and a plurality of apertures extending through said shell into communication with the interior of said conduit, and means for connecting a source of air supply to said conduit.

* * * * *